United States Patent [19]

Fish et al.

[11] Patent Number: 5,058,404

[45] Date of Patent: Oct. 22, 1991

[54] PUSH-BUTTON LOCK ARRANGEMENT

[75] Inventors: Aaron M. Fish, Hampstead; Abraham Toledano, Laval, both of Canada

[73] Assignee: Ilco Unican Inc., Montreal, Canada

[21] Appl. No.: 558,601

[22] Filed: Jul. 24, 1990

[51] Int. Cl.[5] ..... E05B 37/00

[52] U.S. Cl. ..... 70/315; 70/278

[58] Field of Search ..... 70/315, 316, 214, 220, 70/278

[56] References Cited

U.S. PATENT DOCUMENTS

| | | | |
|---|---|---|---|
| 3,115,765 | 12/1963 | Fengler . | |
| 4,027,508 | 6/1977 | McGourty . | |
| 4,627,250 | 12/1986 | Kim | 70/315 |
| 4,748,833 | 6/1988 | Nagasawa . | |
| 4,827,743 | 5/1989 | Kim . | |
| 4,936,894 | 6/1990 | Larsa | 70/315 |
| 4,956,985 | 9/1990 | Kim | 70/315 |

*Primary Examiner*—Robert L. Wolfe

*Attorney, Agent, or Firm*—Fishman, Dionne & Cantor

[57] ABSTRACT

The push-button lock arrangement includes a permutation chamber, and, in accordance with the invention, the combination of the permutation chamber can be changed without dismantling the lock arrangement and without the use of special tools. A cam, which is rotated by a simple screwdriver, activates the end of the lock-out slide of the permutation chamber to put the permutation chamber in its reset mode. The lock arrangement also includes a rotating stop member and a stationary stopper. The rotating stop member is connected to the outside door knob so that the rotation of the outside door knob is constrained to a predetermined angle of rotation.

9 Claims, 5 Drawing Sheets

PUSH-BUTTON LOCK ARRANGEMENT

BACKGROUND OF INVENTION

1. Field of the Invention

The invention relates to improvements in push-button lock arrangements which arrangements include a permutation chamber. More specifically, the invention relates to such an arrangement wherein the combination of the permutation chamber can be changed, when the permutation chamber is mounted in an assembled such arrangement, without dismantling the arrangement and without the use of special tools.

The invention also relates to such an arrangement in which the permutation chamber shaft is constrained to a predetermined angle of rotation, the novel arrangement including means for constraining the rotation of the outside door knob to the same angle of rotation.

2. Description of Prior Art

Permutation chambers for combination locks are well known in the art as illustrated in, for example, U.S. Pat. No. 3,115,765 Fengler, Dec. 31, 1963. In order to change the combination of such a permutation chamber, the present combination is first inserted, and then the end 88 of the lock-out plate 44 (see FIG. 2 of the patent) is pushed inwardly. The new combination is then inserted, and the lock-out plate is then returned to its original position by rotating the input shaft 29.

Also known in the art are combination locks with means for changing the combination. Such combination locks are illustrated in, for example, U.S. Pat. No. 4,748,833, Nagasawa, June 7, 1988, U.S. Pat. No. 4,827,743, Kim, May 9, 1989 and U.S. Pat. No. 4,027,508, McGourty, June 7, 1977.

In the Kim patent, a combination change mechanism is illustrated at 135 in FIGS. 5 and 6. Referring to FIG. 6, the reset assembly includes a plurality of combination setting imposers 153. It can easily be seen that in order to reset the combination in this combination lock, the entire lock must be taken apart.

The Nagasawa patent teaches a combination lock which does not appear to use gears. Instead, it uses a plurality of "keys" illustrated in FIG. 3 of the patent. The procedure for resetting the combination is described at column 6, lines 10 et seq. of the patent. As can be seen, one of the first steps is to remove the block 11 (see FIG. 1 of the patent). Thus, once again, the lock must be taken apart in order to reset the combination.

Although the McGourty combination lock does not have to be dismantled in order to reset the combination, it is noted that the McGourty combination lock does not include a permutation chamber. In accordance with the McGourty patent, a new combination is inserted by first rotating combination change key (see FIG. 3). When the key is rotated, reset slide 58 is lifted from the position shown in FIG. 14 of the patent to the position shown in FIG. 15 of the patent. With reset slide 58 lifted, gears 65 are disengaged from gears 31 and gear 70 is disengaged from gear 42. In this position, a new combination can be entered. As above-mentioned, the McGourty combination lock does not include a permutation chamber. Accordingly, the McGourty patent is not directed at subject matter similar to the subject matter of the present application.

SUMMARY OF INVENTION

It is therefore an object of the invention to provide improvements in push-button lock arrangements including a permutation chamber.

It is a more specific object of the invention to provide improvements in such arrangements wherein the combination of the permutation chamber can be changed, when the permutation chamber is mounted in an assembled such lock arrangement, without dismantling the arrangement and without the use of special tools.

It is a still further object of the invention to provide such a lock arrangement in which the permutation chamber shaft is constrained to a predetermined angle of rotation, the improvement comprising means for constraining the rotation of the outside door knob of the lock arrangement to the same angle of rotation.

In accordance with the invention there is provided a push-button lock arrangement for mounting on a door having a front side and a rear side;

said arrangement comprising:

a housing mounted on the front side of said door;

a permutation chamber mounted in said housing, said permutation chamber having an internal lock-out slide, said lock-out slide having an external end section whereby, when said end section is moved towards said permutation chamber, the combination of said permutation chamber can be reset;

a combination resetting means mounted on said rear side of said door and extending, through said door into said housing, and including cam means in said housing to engage said end section to move said end section towards said permutation chamber when said cam means is moved towards said end section and, means for moving said cam means towards said end section.

Further in accordance with the invention there is provided a push-button lock arrangement for mounting on a door having a front side and a rear side;

said arrangement comprising:

a housing mounted on the front side of said door;

an outside door knob mounted exteriorly of said housing adjacent an opening therein;

a permutation chamber mounted in said housing, said permutation chamber having an input shaft, which is constrained to a predetermined angle of rotation;

said input shaft being connected to said outside door knob for rotation therewith;

said permutation chamber further including an output shaft connected to said input shaft for rotation therewith;

a rotating stop member mounted on said output shaft for rotation therewith;

a stationary stop member spaced from the position of said rotating stop member, when said rotating stop member is at its rest position, by said preset angle;

rotation of said outer door knob being transmitted, when said permutation chamber is in its released condition, to said input shaft and, thereby, to said output shaft and said rotating stop member;

whereby, the rotation of said outside door knob is constrained to said predetermined angle.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
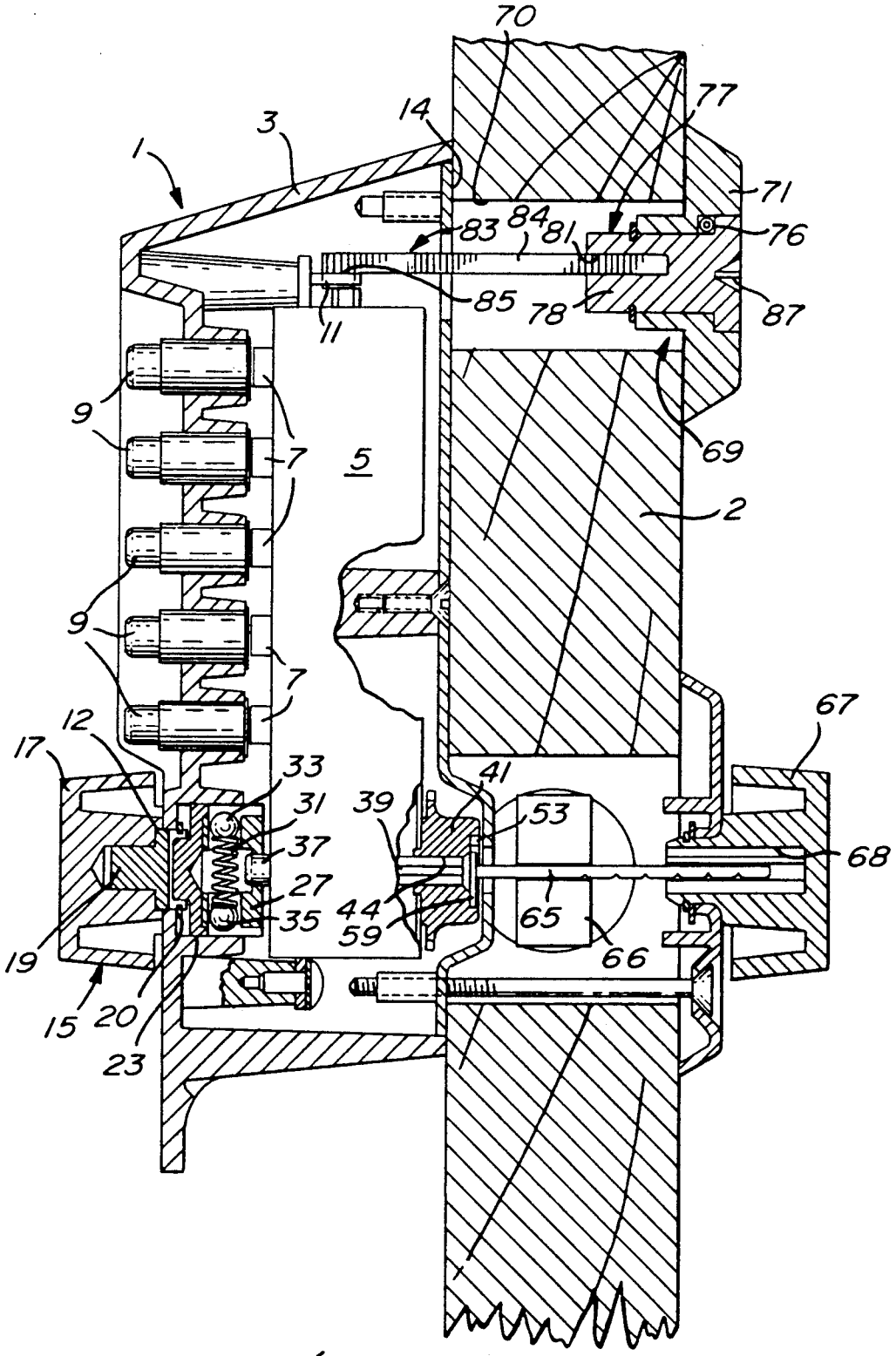
FIG. 1 is a sectional side view of a lock arrangement in accordance with the invention.

Referring to FIG. 1, the push-button arrangement, illustrated generally at 1, includes an outer housing 3 in which is disposed a permutation chamber 5. The permutation chamber, as is well known in the art, has a plurality of key stems 7 extending therefrom. Associated with each key stem is a push-button 9 which extends out of the outer housing. In addition, the permutation chamber has an end 11 of the lock-out plate as described in U.S. Pat. No. 3,115,765, the contents of which are incorporated herein by reference.

Figure 2:
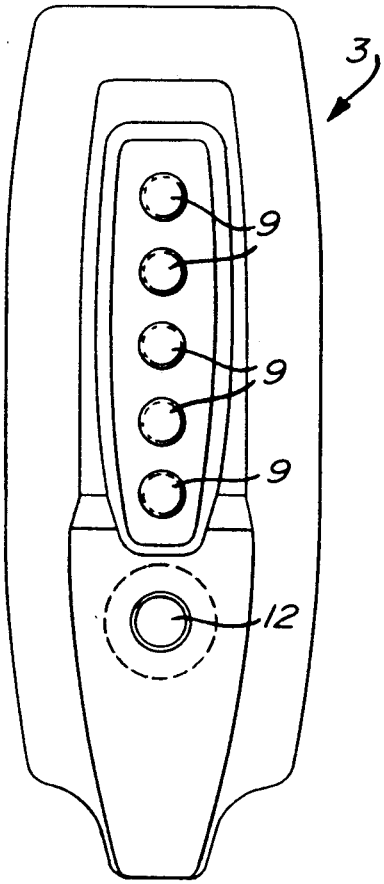
FIG. 2 is a front view of the outer housing of the lock arrangement.
Figure 3:
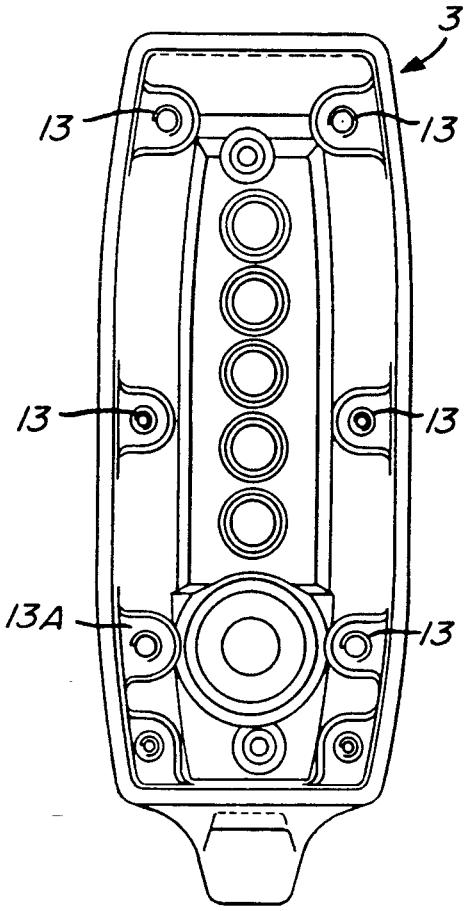
FIG. 3 is a rear view of the outer housing of the lock arrangement.

FIG. 2 is a front view of the housing 3 which illustrates the position of the push-buttons as well as the position of an opening 12 for the outside door knob as will be described below. FIG. 3 illustrates a rear view of the outer housing which illustrates a plurality of bosses 13 for connecting the outer housing to back plate 14 which is mounted on the front side of door 2. As seen in FIG. 1, the outer housing and the back plate 14 are mounted together on the front side of the door 2.

In FIG. 3, 13A is a boss which, in accordance with one aspect of the invention, comprises a stationary stopper as will be discussed below.

Figure 4:
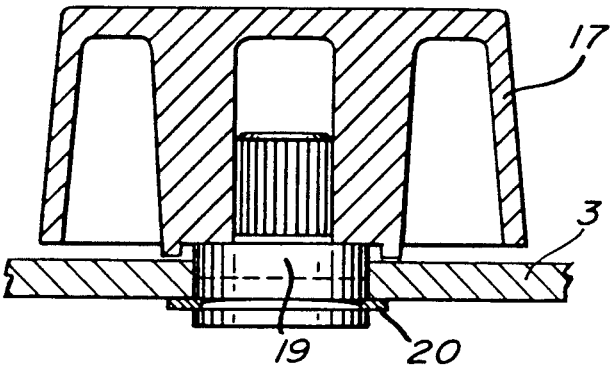
FIG. 4 is a side view of the outside turn knob of the lock arrangement.
Figure 5:
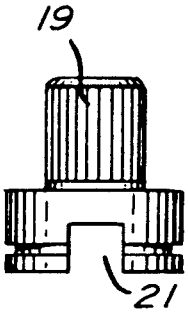
FIG. 5 illustrates the outside turn knob insert.

Returning to FIG. 1, the push-button lock arrangement also includes an outside door knob arrangement 15 which includes an outside door knob 17. An insert 19 is inserted into a central opening of the outside door knob as illustrated in both FIGS. 1 and 4. As seen in FIG. 5, the insert 19, which is circular in cross-section, includes a diametrical slot 21.

Figure 6:
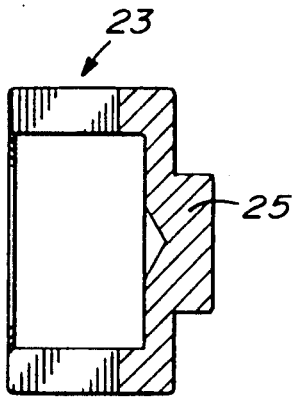
FIG. 6 is a sectional side view of the sleeve connected to the outside turn knob insert.

Extending from the insert 19 is a sleeve 23 which is also circular in cross-section and, as illustrated in FIG. 6, has a diametric lug 25 extending from one end of the sleeve. The lug 25 is press fit into knob 17 and the assembly of the knob 17 and insert 19 is held in place in the housing 3 by retaining ring 20 as illustrated in FIG. 4.

Figure 7:
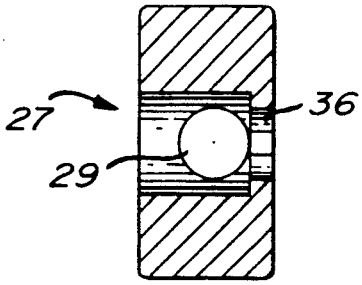
FIG. 7 is a sectional side view of the shaft encircled by the sleeve illustrated in FIG. 6.

Sleeve 23 encircles a shaft member 27 which is also illustrated in FIG. 7. The shaft is circular in cross section and has a diametric opening 29. In the diametric opening is a spring 31 with ball bearings 33 and 35 at either end of the spring. The sleeve 23, shaft 27 and associated spring 31 and ball bearings 33 and 35 form a clutch whose operation will be described below.

The shaft 27 has a central opening 36, and the input shaft 37 of the permutation chamber 5 is inserted into the central opening 36 of the permutation chamber 5. As the shaft 37 is connected to the outside door knob 17 through the clutch arrangement (sleeve 23, shaft 27, spring 31 and ball bearings 33 and 35) and the insert 19, shaft 37 will rotate, when it is free to rotate, with the rotation of the outside door knob 17.

Output shaft 39 of the permutation chamber 5 is connected to a rotating stop member 41. As is well known in the art, the input shaft 37 of the permutation chamber 5 is connected to the output shaft 39 of the permutation chamber 5 and typically, the input and output shafts 37 and 39 are simply a single shaft with an input end 37 and an output end 39 which single shaft extends through the permutation chamber 5.

Figure 8:
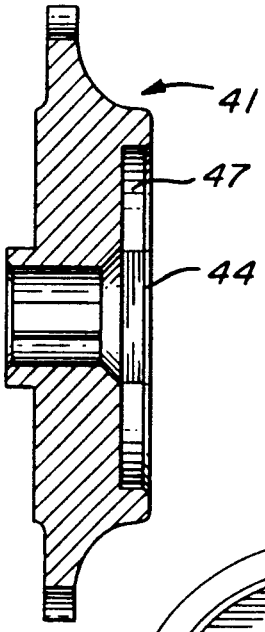
FIG. 8 is a sectional side view of the rotating stop member of the lock arrangement.
Figure 9:
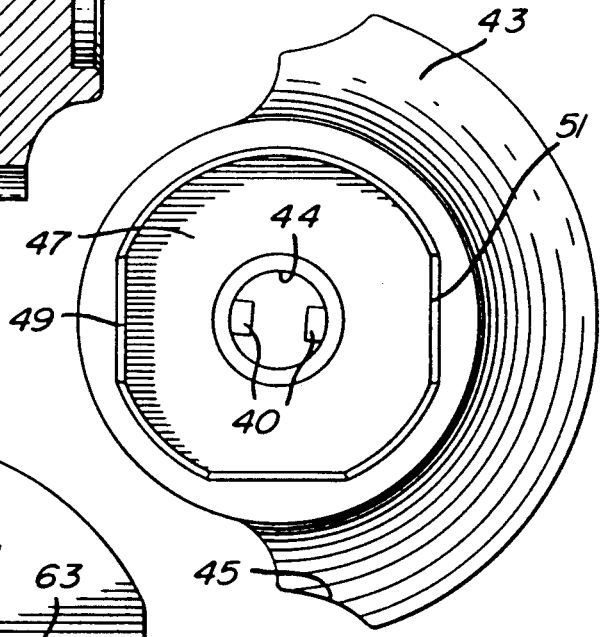
FIG. 9 is a front view of the rotating stop member.

The rotating stop member 41 is shown in more detail in FIGS. 8 and 9. As can be seen in these Figures, the rotating stop member 41 is circular in shape and includes an expanded portion 43. The expanded portion includes a stationary stop abutment portion 45 and a central depression 47. The central depression 47 includes straight-edged portions 49 and 51.

Figure 10:
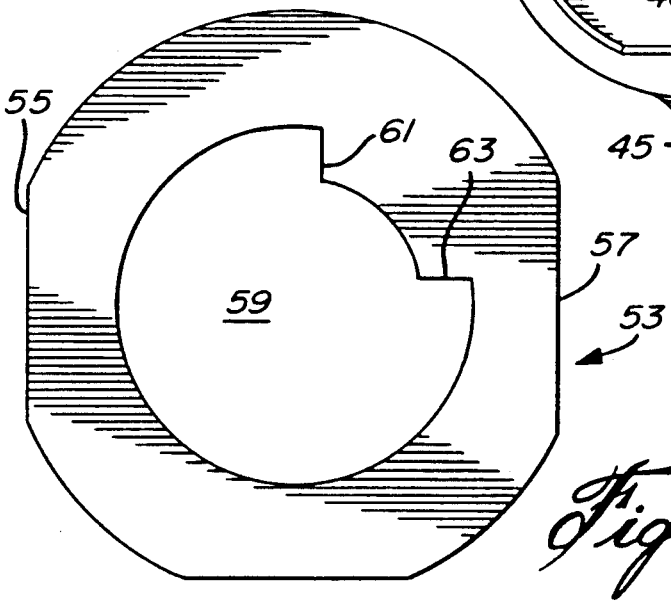
FIG. 10 illustrates the connecting bar cam of the lock arrangement.

Mounted in the depression 47 of the stationary stop member 41 is a connecting bar cam 53 which is illustrated in greater detail in FIG. 10. As seen in FIG. 10, the connecting bar cam 53 includes straight edges 55 and 57 which will abut with respective ones of the straight edges 49 and 51 of the depression 47 in the rotating stop member 41. The connecting bar cam also includes a cut-out portion 59 which has abutment edges 61 and 63.

Lugs 40, of rotating stop member 41, shown in FIG. 9, fit into mating slots of the output shaft 39 so that the rotating stop member 41 will rotate with the rotation of the output shaft 39. As seen below, connecting bar cam 53 rotates with the rotation of rotating stop member 41, so that connecting bar cam 53 will also rotate with the rotation of output shaft 39.

Connecting bar 65 is freely disposed in the opening 59 of connecting bar cam 53. Thus, as connecting bar cam 53 rotates, driven by the rotation of output shaft 39, one of the abutment edges 61 or 63 of the connecting bar cam will eventually engage the connecting bar 65 and cause the connecting bar 65 to rotate with the rotation of the connecting bar cam. Thus, connecting bar 65 will be caused to rotate by rotation of output shaft 39 of permutation chamber 5. The output shaft 39 is, of course, as above-described, driven by outside door knob 17, so that the connecting bar is, on final analysis, driven by the rotation of outside door knob 17.

The connecting bar 65 will be connected to a means for opening the lock, for example to a dead latch assembly 66 whereby the dead latch will be withdrawn upon rotation of the connecting bar 65. Obviously, the dead latch assembly embodiment is simply an example and the connecting bar would be connected with other means, well known in the art, depending on the type of lock being used.

Inside door knob 67 has a central opening 68 into which connecting bar 65 extends so that the connecting bar 65 will rotate with the rotation of the inside door knob and vice-versa.

Figure 11:
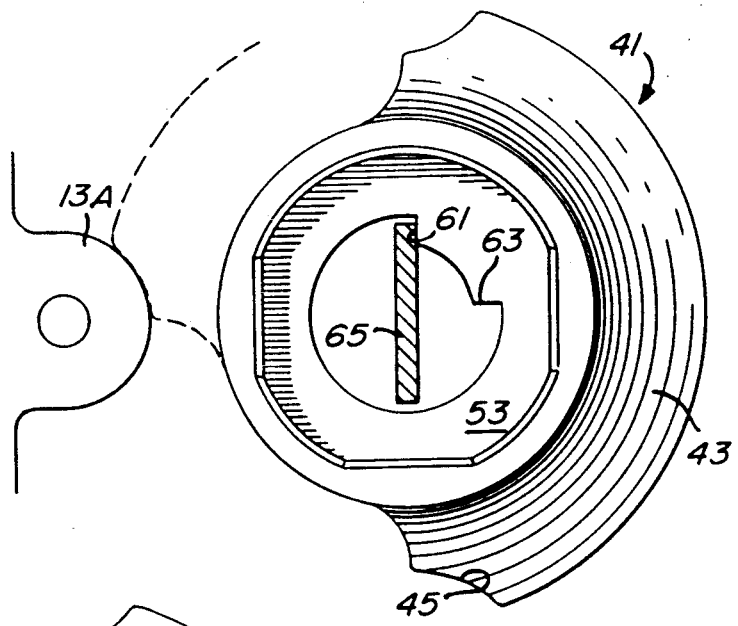
FIGS. 11, 12 and 13 illustrate the different positions of the connecting bar cam in the rotating stop member used with different latch and bolt arrangements.
Figure 12:
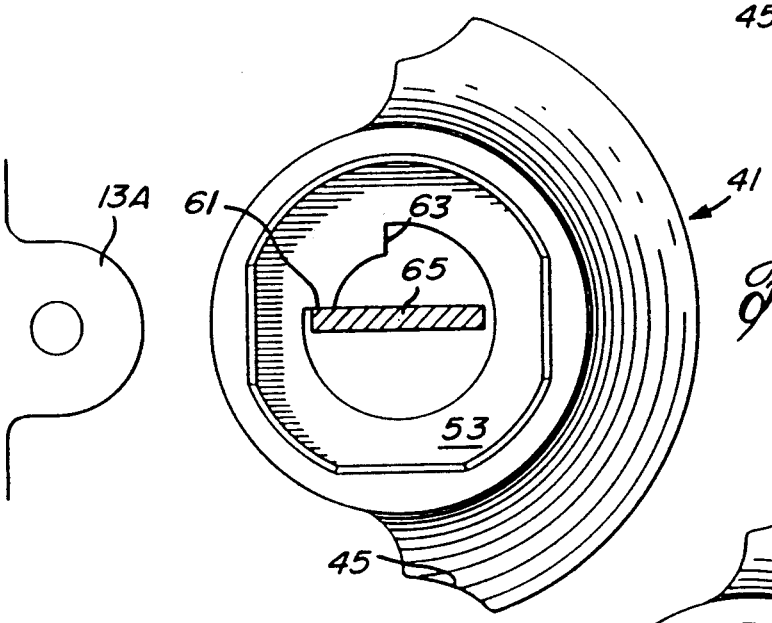
Figure 13:
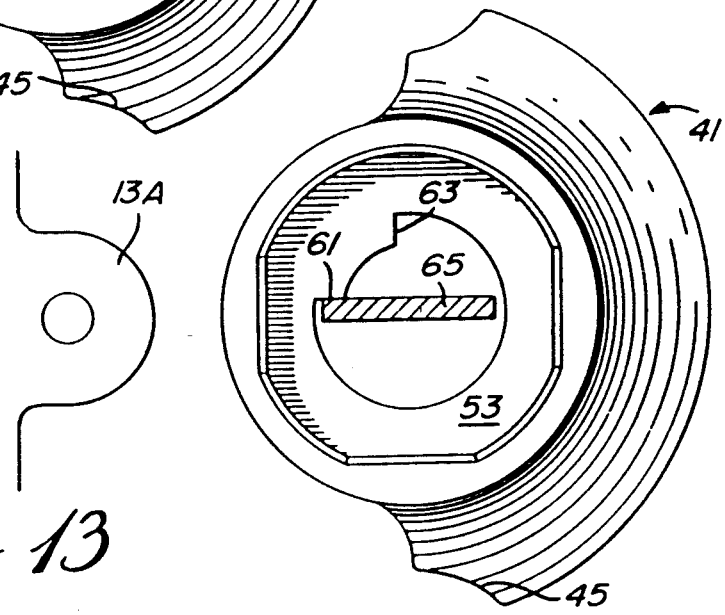

Turning now to FIGS. 11, 12 and 13, it will be illustrated how the rotation of the knob is constrained to a predetermined angle of rotation using the rotating stop member and the stationary stopper above-described. FIG. 11 illustrates how the connecting bar cam is connected in the event of a night latch embodiment, FIG. 12 illustrates the same with respect to a dead latch embodiment and FIG. 13 illustrates the same with respect to a dead bolt embodiment.

Referring to FIG. 11, when rotating stop member 41 is rotated, by rotation of outside door knob 17, abutment portion 45 will eventually abut against the stationary stopper, that is, the boss 13A. At this point, the rotation of the rotating stop member 41 will be arrested so that the rotation of the outside door knob 17 will also be stopped. Accordingly, the rotation of the outside door knob is constrained to a predetermined angle of rotation which is varied either by the shape of the expanded portion 43 and the placement of the abutment portion 45 relative to the stationary stopper 13A.

Figure 14:
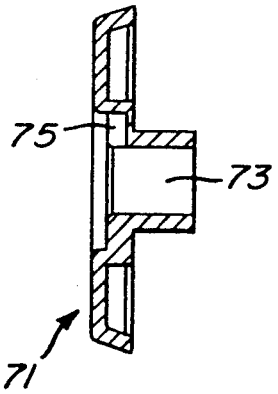
FIG. 14 is a sectional side-view of the combination change rose of the combination change means of the lock arrangement.
Figure 14A:
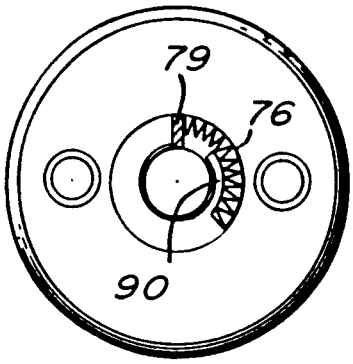
FIG. 14A is a front view of the combination change rose of FIG. 14.

The lock arrangement in accordance with the invention also includes a combination resetting arrangement, illustrated generally at 69 in FIG. 1. The arrangement 69, which extends from the rear of door 2 towards the front thereof through opening 70, includes a combination change rose 71 which is illustrated in more detail in FIG. 14. As can be seen in FIGS. 14 and 14A, the rose 71 which is circular in cross-section, has a central opening 73 and a spring depression 75. As seen in FIG. 14A, a spring 76 is disposed in the spring depression 75.

Figure 15:
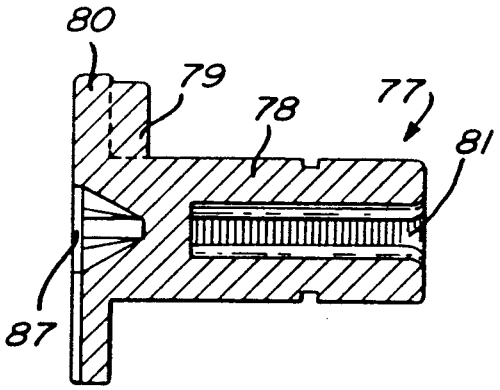
FIG. 15 is a sectional side view of the combination change tail piece driver.

Extending through the central opening 73 of the rose 71 is a combination change tail piece driver 77. Turning to FIG. 15, the combination change tail piece driver 77, which is circular in cross-section, includes an extending member 78 and a lug 79 disposed on the head portion 80 of the combination change tail piece driver 77. The portion of lug 79 relative to depression 75 is shown in FIG. 14A. An opening 81 extends into the extending member 78 centrally thereof, and, as can be seen in FIG. 1, tail piece 83 extends into the central opening 81 so that the tail piece 83 rotates with the rotation of the combination change tail piece driver 77. The tail piece 83 includes an elongated portion 84 and a cam 85 extending from the free end of the elongated portion 84. The combination change tail piece driver also includes a screwdriver slot 87.

Figure 16:
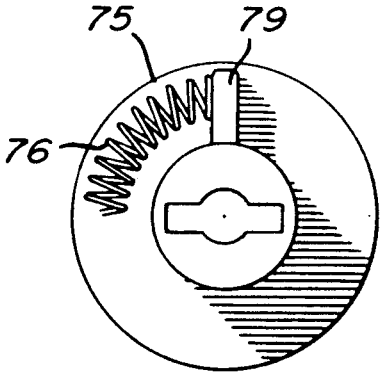
FIG. 16 is a schematic view illustrating means for returning the combination change tail piece driver to its original position.

In operation, in order to change the combination of the permutation chamber, the presently set combination is first punched in via push-buttons 9. A screwdriver, or the like, is then inserted into the screwdriver slot 87 to rotate the combination change tail piece driver 77. As seen in FIG. 14A, the rotation of the screwdriver is constrained to a predetermined angle, 30 degrees in FIG. 14A, because, after the screwdriver is rotated through this predetermined angle, lug 79 engages abutment 80 so that no further rotation of the screwdriver is possible. Rotation of tail piece driver 77 rotates tail piece 83 so that cam 85 contacts end 11 of the lock-out plate to move end 11 towards the permutation chamber 5, whereby to put the permutation chamber 5 in a combination reset mode. As can be seen in association with FIG. 16, when the combination change tail piece driver is rotated, it is rotated against the force of spring 76. Thus, when the rotating force is released, the spring 76 will force lug 79, and therefore combination change tail piece driver 77 back to its original position.

The outside door knob is then turned counterclockwise to cancel the existing combination.

With the permutation chamber 5 in its reset mode, a new combination is punched in using the push-buttons 9. The outside door knob is then rotated clockwise whereby the permutation chamber is no longer in its release mode. When it is next desired to open the door, the reset combination must be punched in to the combination chamber 5 via the push-buttons 9.

As the combination change tail piece driver 77 is rotated by a simple screwdriver and as the arrangement does not have to be dismantled in order to reset the combination of the permutation chamber 5, it can be seen that, as per the objectives of this application, there has been provided a push-button lock arrangement wherein the combination of the permutation chamber can be changed without dismantling the arrangement and without the use of special tools. In addition, there is provided an arrangement in which the angle of rotation of the outside door knob is constrained to a predetermined angle.

Although a specific embodiment has been described, this was for the purpose of illustrating, but not limiting, the invention. Various modifications, which will come readily to the mind of one skilled in the art, are within the scope of the invention as defined in the appended claims.

We claim:

1. A push-button lock arrangement for mounting on a door having a front side and a rear side;

said arrangement comprising:

a housing mounted on the front side of said door;

a permutation chamber mounted in said housing, said permutation chamber having an internal lock-out slide, said lock-out slide having an external end section whereby, when said end section is moved towards said permutation chamber, the combination of said permutation chamber can be reset;

a combination resetting means mounted on said rear side of said door and extending, through said door into said housing, and including cam means in said housing to engage said end section to move said end section towards said permutation chamber when said cam means is moved towards said end section and, means for moving said cam means towards said end section.

2. An arrangement as defined in claim 1 wherein said combination resetting means is mounted on said rear side of said door by a combination change rose, said combination change rose having an opening extending therethrough.

3. An arrangement as defined in claim 2 and further including a tail piece driver extending through said opening of said combination change rose;

a tail piece extending from the free end of said tail piece driver and being rotatable therewith;

said cam means being disposed at the free end of said tail piece;

said tail piece driver being rotatable by a screwdriver or the like.

4. An arrangement as defined in claim 3 and further including:

a depression in said rose for housing a spring;

a lug on said tail piece driver contacting said spring when said tail piece driver is rotated;

whereby, said tail piece driver will be rotated against the action of said spring so that said tail piece driver will be returned to its at rest position by said spring when the force for rotating said tail piece driver is removed.

5. A push-button lock arrangement for mounting on a door having a front side and a rear side;

said arrangement comprising:

a housing mounted on the front side of said door;

an outside door knob mounted exteriorly of said housing adjacent an opening therein;

a permutation chamber mounted in said housing, said permutation chamber having an input shaft, which is constrained to a predetermined angle of rotation;

said input shaft being connected to said outside door knob for rotation therewith;

said permutation chamber further including an output shaft connected to said input shaft for rotation therewith;

a rotating stop member mounted for rotation with said output shaft;

a stationary stop member spaced from the position of said rotating stop member, when said rotating stop member is at its rest position, by said preset angle;

rotation of said outer door knob being transmitted, when said permutation chamber is in its released condition, to said input shaft and, thereby, to said output shaft and said rotating stop member;

whereby, the rotation of said outside door knob is constrained to said predetermined angle.

6. An arrangement as defined in claim 5 wherein said stationary stop member comprises a boss in the interior of said housing.

7. An arrangement as defined in claim 6 wherein said rotating stop member is circular in shape and includes an expanded section;

a stationary stop member abutment portion on said expanded portion which abuts said stationary stop member when said outside door knob has been rotated through said predetermined angle.

8. An arrangement as defined in claim 7 wherein said rotating stop member has a central depression therein;

a connecting bar cam mounted in said depression such that said connecting bar cam rotates with said rotating stop member;

said rotating stop member being connected to said output shaft for rotation therewith;

said connecting bar cam having abutment edges, said abutment edges engaging said connecting bar upon rotation of said connecting bar cam;

whereby, when said connecting bar rotates, driven by the rotation of said outer door knob, said abutment edges thereof will engage said connecting bar so that said connecting bar will rotate with the rotation of said outer door knob.

9. An arrangement as defined in claim 8 wherein the position of said connecting bar cam in said depression of said rotating stop member can be changed whereby the arrangement can be used with different type locks.

* * * * *